US007269367B2

(12) United States Patent
Kwon et al.

(10) Patent No.: US 7,269,367 B2
(45) Date of Patent: Sep. 11, 2007

(54) FUSING UNIT TO CONTROL PRESSURE APPLIED TO PRINTING MEDIUM, AN IMAGE FORMING APPARATUS HAVING THE SAME AND A METHOD FOR CONTROLLING FUSING PRESSURE

(75) Inventors: Jae-min Kwon, Anyang-si (KR); Jin-yoon Kim, Suwon-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 13 days.

(21) Appl. No.: 11/281,692

(22) Filed: Nov. 18, 2005

(65) Prior Publication Data

US 2006/0239703 A1 Oct. 26, 2006

(30) Foreign Application Priority Data

Apr. 20, 2005 (KR) ..... 10-2005-0032681

(51) Int. Cl.
*G03G 15/00* (2006.01)

(52) U.S. Cl. ..... 399/45; 399/331

(58) Field of Classification Search ..... 399/45, 399/67, 122, 331, 332
See application file for complete search history.

(56) References Cited

U.S. PATENT DOCUMENTS 4,719,489 A * 1/1988 Ohkubo et al. ..... 399/45
4,873,553 A * 10/1989 Inaba ..... 399/67
6,035,160 A * 3/2000 Kim ..... 399/122
6,577,827 B2 * 6/2003 Matsuura et al. ..... 399/45

FOREIGN PATENT DOCUMENTS

| | | |
|---|---|---|
| JP | 08-146812 | 6/1996 |
| JP | 10-250874 | 9/1998 |
| JP | 2004-093759 | 3/2004 |
| JP | 2004-117518 | 4/2004 |

* cited by examiner

*Primary Examiner*—David M. Gray
*Assistant Examiner*—Ruth N LaBombard
(74) *Attorney, Agent, or Firm*—Roylance, Abrams, Berdo & Goodman, L.L.P.

(57) ABSTRACT

A fusing unit of an image forming apparatus is capable of controlling fusing pressure according to detailed types of printing medium without deteriorating printing speed. A first roller rotates about a first rotation shaft CR1. A second roller rotates in contact with the first roller about a second rotation shaft CR2 and is movable along the outer circumference of the first roller. A moving unit relocates the second roller according to a type of printing medium. A pressing unit presses the second roller toward the first roller by applying different pressures according to a position of the second roller with respect to the first roller.

19 Claims, 5 Drawing Sheets

FUSING UNIT TO CONTROL PRESSURE APPLIED TO PRINTING MEDIUM, AN IMAGE FORMING APPARATUS HAVING THE SAME AND A METHOD FOR CONTROLLING FUSING PRESSURE

CROSS-REFERENCE TO RELATED APPLICATIONS

This application claims the benefit under 35 U.S.C. § 119(a) of Korean Patent Application No. 2005-32681, filed Apr. 20, 2005, the entire contents of which are hereby incorporated by reference.

BACKGROUND OF THE INVENTION

1. Field of the Invention

The present invention relates to an image forming apparatus. More particularly, the present invention relates to a fusing unit of an image forming apparatus for fixing a transferred image on a printing medium, and a method for controlling a fusing pressure.

2. Description of the Related Art

Generally, electrophotographic image forming apparatuses, such as a printer, a photocopier and a facsimile, obtain a desired image by fixing on a printing medium a visible toner image transferred thereon with a fusing unit that has a heating roller and a pressing roller.

However, the heat and pressure required to fix the visible image on the printing medium differ according to a type of printing medium, particularly the thickness thereof. As a result, to effectively fuse in a manner appropriate for each type of printing medium, methods of controlling heat capacity transmitted to the printing medium and methods of controlling pressure applied to the printing medium have been developed.

To control the heat capacity applied to the printing medium, the time of transmitting the heat to the printing medium is controlled by adjusting a feeding velocity of the printing medium. When fixing an image on a printing medium having a great thickness and a high heat capacity, the printing medium is slowly fed so that heat can be evenly transmitted to the printing medium. By elongating the feeding time of the printing medium passing through the fusing unit, enough heat may be transmitted to the printing medium. According to this method, however, much time is required for image formation, thereby degrading printing efficiency.

The method of controlling the pressure applied to the printing medium according to the thickness of the printing medium may be achieved by a user manually operating a lever exposed out of the image forming apparatus. However, when the type of the printing medium is frequently changed or when a plurality of users share one image forming apparatus, it is cumbersome to operate the lever for every different type of printing medium or for each individual user to do so. Furthermore, according to this method, control of the pressure for subdivided types of the printing medium is difficult.

Accordingly, a need exists for an image forming apparatus having an improved fusing unit that controls the fusing pressure depending on the type of printing medium.

SUMMARY OF THE INVENTION

Accordingly, an aspect of the present invention is to provide a fusing unit capable of controlling fusing pressure according to detailed types of printing medium without deteriorating printing speed, an image forming apparatus having the same, and a method for controlling the fusing pressure.

To achieve the above-described aspects of the present invention, a fusing unit includes a first roller rotating about a first rotation shaft CR1, a second roller rotating in contact with the first roller about a second rotation shaft CR2 and movable along the outer circumference of the first roller, a moving unit relocating the second roller according to a type of printing medium, and a pressing unit pressing the second roller toward the first roller by applying different pressure according to a position of the second roller with respect to the first roller.

The above aspects may also be achieved by providing an image forming apparatus including a fusing unit for fixing a visible image that is transferred on a printing medium in accordance with printing information. The fusing unit includes a first roller rotating about a first rotation shaft CR1, a second roller rotating in contact with the first roller about a second rotation shaft CR2 and movable along the outer circumference of the first roller, a moving unit relocating the second roller according to a type of printing medium, and a pressing unit pressing the second roller toward the first roller by applying different pressure according to a position of the second roller with respect to the first roller.

According to an exemplary embodiment of the present invention, the pressing unit includes a pivoting lever of which one end is pivotably mounted to a third rotation shaft CR3 disposed at a different position from the first and the second rotation shafts CR1 and CR2 and the other end slidably mounts the second rotation shaft CR2 in a length direction of the pivoting lever. A resilient member has one end mounted to the second rotation shaft CR2 and the other end mounted on the pivoting lever between the second and the third rotation shafts CR2 and CR3. The other end of the resilient member is preferably mounted to the third rotation shaft. The other end of the pivoting lever has a groove adapted to slidably receive the second rotation shaft in a length direction of the pivoting lever. The moving unit includes a braking roller rotated in contact with and together with the second roller, an electronic clutch brake supplying a rotation load to the braking roller, and stoppers restricting movement of the second roller on the outer circumference of the first roller within a predetermined distance. Additionally, the fusing unit may further include a control unit that controls the electronic clutch brake to vary the rotational load applied to the braking roller according to the type of printing medium.

The aspects of the present invention may be achieved by a method of controlling fusing pressure in a fusing unit, which includes first and second rollers rotating about first and second rotation shafts CR1 and CR2, respectively, in tight contact with each other. The method includes a) setting a distance for the second roller to move along an outer circumference of the first roller according to a type of printing medium, and b) varying contacting pressure between the first and the second rollers by moving the second roller along the outer circumference of the first roller by the set distance.

According to an exemplary embodiment of the present invention, the step a) includes setting a voltage V to be applied to an electronic clutch brake that supplies a rotational load to a braking roller rotating together with and in contact with the second roller. The electronic clutch brake may supply the rotational load directly to the second roller rotating about the second rotation shaft.

The step a) may include setting an initial voltage V1 to be applied to the electronic clutch brake that supplies the rotational load to the braking roller rotating together with and in contact with the second roller, an initial voltage application time T1, and a final voltage V2. Also, step b) may include b1) applying the initial voltage V1 to the electronic clutch brake, and b2) applying the final voltage V2 in the initial voltage application time after applying the initial voltage V1 to the electronic clutch brake.

Other objects, advantages and salient features of the invention will become apparent from the following detailed description, which, taken in conjunction with the annexed drawings, discloses preferred embodiments of the invention.

BRIEF DESCRIPTION OF THE DRAWING FIGURES

The above aspects and other features of the present invention will become more apparent by describing in detail exemplary embodiments thereof with reference to the attached drawing figures, wherein.

Throughout the drawings, like reference numerals will be understood to refer to like parts, components and structures.

DETAILED DESCRIPTION OF EXEMPLARY EMBODIMENTS

Figure 1:
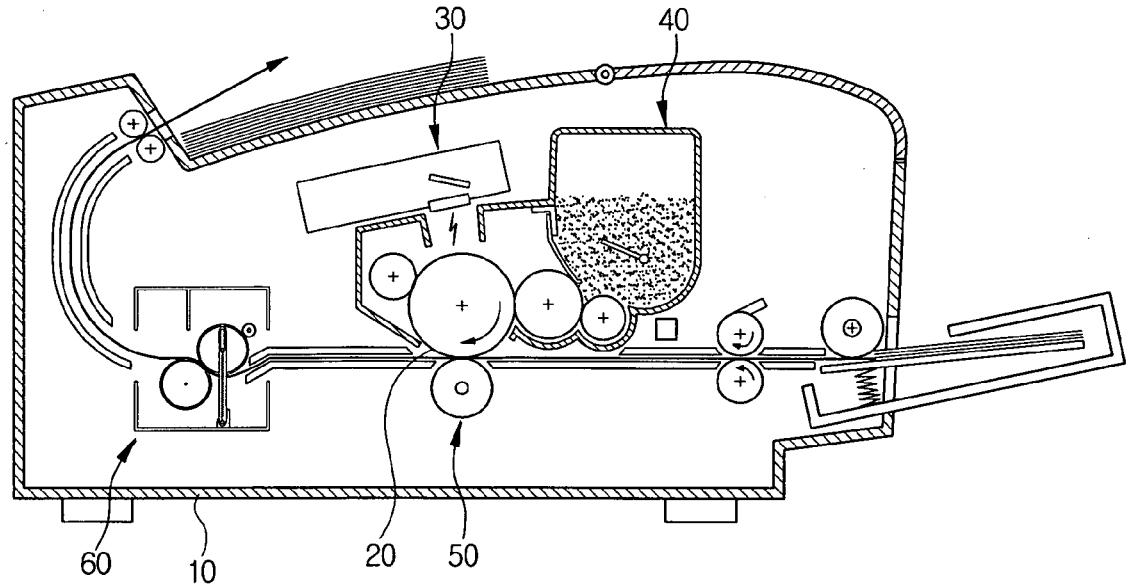
FIG. 1 is an elevational view in partial cross section schematically showing an image forming apparatus according to an exemplary embodiment of the present invention.

Hereinafter, certain exemplary embodiments of the present invention are described in detail with reference to the accompanying drawing figures.

In the following description, the same drawing reference numerals are used for the same elements throughout the drawings. The matters defined in the description, such as a detailed construction and elements thereof, are provided to assist in a comprehensive understanding of the invention. Thus, it is apparent that the present invention may be carried out without those defined matters. Also, well-known functions or constructions are omitted to provide a clear and concise specification.

Referring to FIG. 1, an image forming apparatus according to an exemplary embodiment of the present invention includes a laser scanning unit 30 that forms an electrostatic latent image onto a photoconductive medium 20 according to printing data by irradiating a laser beam thereon. A developing unit 40 develops the electrostatic latent image formed on the photoconductive medium into a visible image. A transfer unit 50 transfers the visible image onto a printing medium. A fusing unit 60 fixes the transferred visible image on the printing medium by varying fusing pressure depending on a type of printing medium. Since the photoconductive medium 20, the laser scanning unit 30, the developing unit 40 and the transfer unit 50 are well-known in the relevant art, structures and operations thereof are not described in detail.

Figure 2:
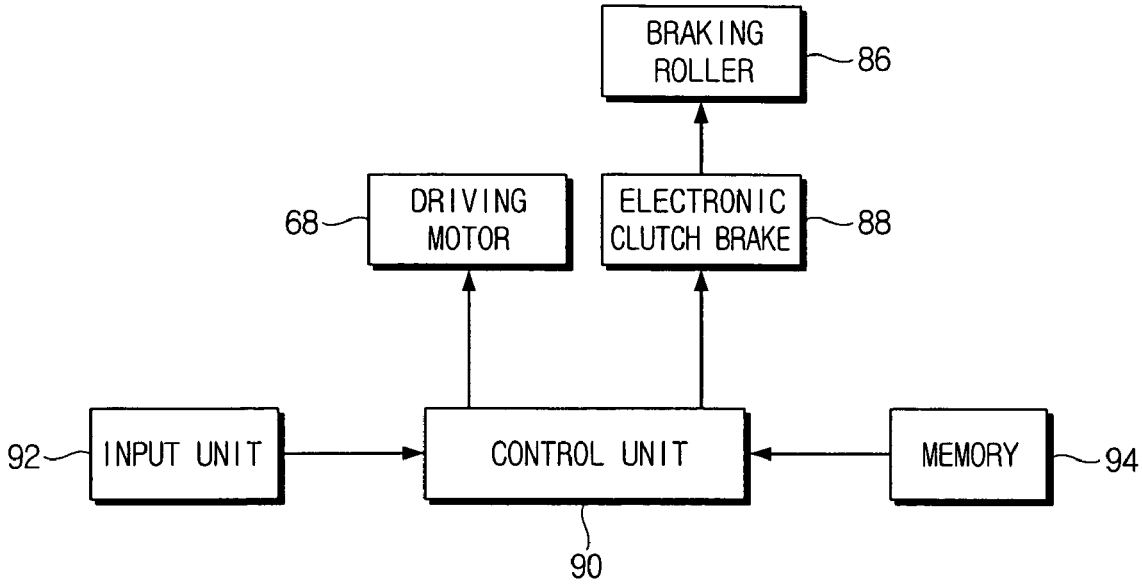
FIG. 2 is a block diagram of some structure of the image forming apparatus of FIG. 1.
Figure 3A:
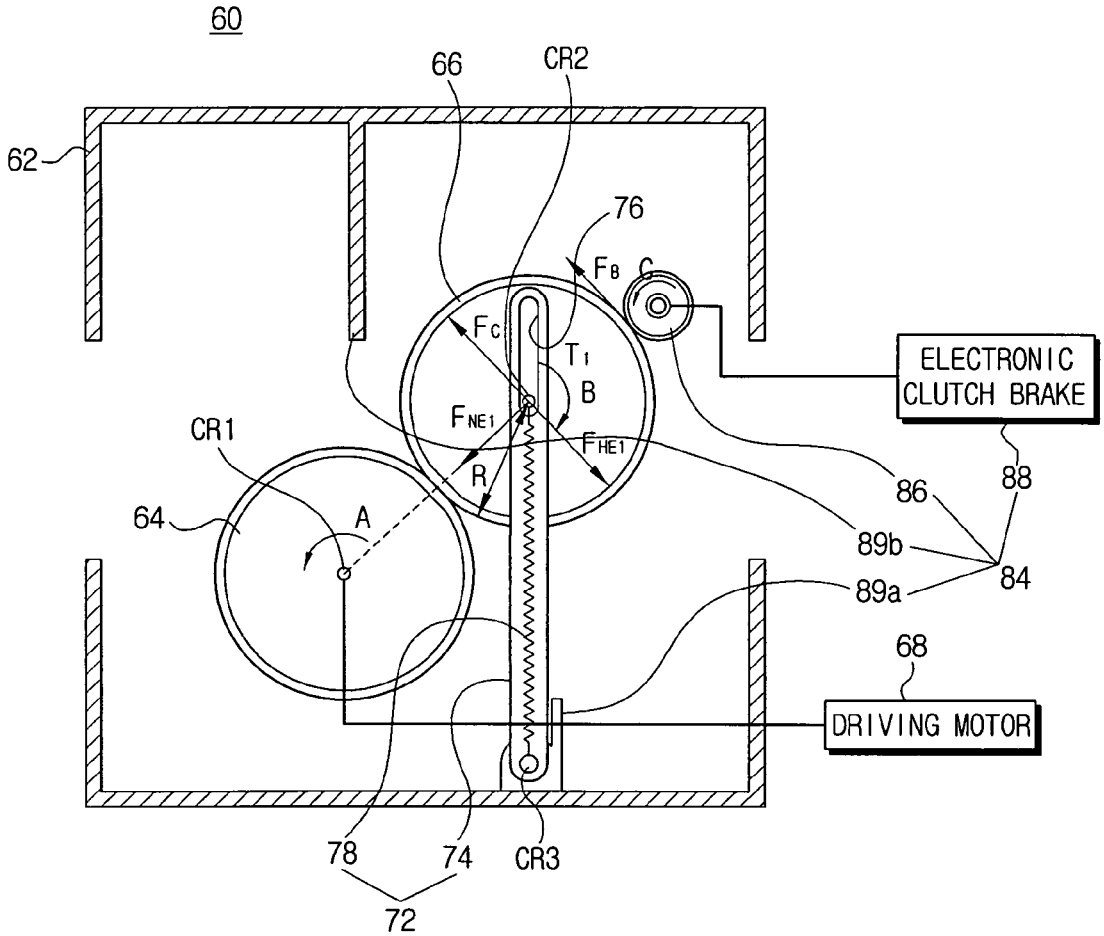
FIGS. 3A and 3B are elevational views in partial cross section of a fusing unit of the image forming apparatus of FIG. 1.

Referring to FIGS. 2 to 3A, the fusing unit 60 includes a housing 62, a first roller 64, a second roller 66, a driving motor 68, a pressing unit 72, and a moving unit 84.

The housing 62 encloses therein the first and the second rollers 64 and 66 and provides the appearance of the fusing unit 60.

The first roller 64 heats the printing medium and includes a halogen lamp. The first roller 64 rotates in connection with the driving motor 68 about a first rotation shaft CR1.

The second roller 66 rotates together with the first roller 64 in tight contact with the first roller 64. More specifically, the second roller 66 receives power from the first roller 64 and rotates about a second rotation shaft CR2. Additionally, the second roller 66 is mounted on the housing 62 to be movable along an outer circumference of the first roller 64.

The driving motor 68 is connected to the first roller 64 for power transmission therebetween to rotate the first roller 64 about the first rotation shaft CR1 according to signals from a control unit 90.

The pressing unit 72 presses the second roller 66 toward the first roller 64 by applying different pressure according to a position of the second roller 66 with respect to the first roller 64. The pressing unit 72 includes a pivoting lever 74 and a resilient member 78.

One end of the pivoting lever 74 is pivotally mounted on a third rotation shaft CR3 formed on the housing 62 while the other end is mounted to the second rotation shaft CR2. A groove 76 of a predetermined length is provided at the other end of the pivoting lever 74 so that the second rotation shaft CR2 may slide therein in a lengthwise direction of the pivoting lever 74. Although the third rotation shaft CR3 is formed on the housing 62 of the fusing unit 60 according to this exemplary embodiment, the third rotation shaft CR3 may be disposed on a main body 10 of the image forming apparatus or on a rib extending from the main body 10. However, the third rotation shaft CR3 should not be disposed at the same location as the first and the second rotation shafts CR1 and CR2, so that the resilient member 78 may be extended and contracted as the second roller 66 moves along the outer circumference of the first roller 64.

The resilient member 78 is connected to the third rotation shaft CR3 at a first end and to the second rotation shaft CR2 at the second other end. Alternatively, the first end of the resilient member 78 may be connected to the pivoting lever 74 between the second and the third rotation shafts CR2 and CR3. Although the present exemplary embodiment adopts a tension spring as the resilient member 78, other various resilient materials, such as rubber, may be used.

The moving unit 84 enables the second roller 66 to move along the outer circumference of the first roller 64. The moving unit 84 includes a braking roller 86, an electronic clutch brake 88, and first and second stoppers 89*a* and 89*b*.

The braking roller 86 rotates about a rotation shaft thereof, and tightly contacts the second roller 66. As the second roller 66 moves along the outer circumference of the first roller 64, the braking roller 86 moves together with the second roller 66. The braking roller 86 moves the second roller 66 along the outer circumference of the first roller 64 by providing a rotation load $F_B$ when the second roller 66 rotates about the second rotation shaft CR2. At this time, the resilient member 78 compresses in a lengthwise direction of the pivoting lever 74 and accordingly, the pressure applied by the second roller 66 to the first roller 64 is changed. Also, the braking roller 86 provides the rotation load $F_B$ to the second roller 66 rotating about the second rotation shaft CR2, the rotation load $F_B$ being proportional to a voltage V applied to the electronic clutch brake 88.

The electronic brake 88 generates an electromagnetic force by being supplied with a predetermined voltage and provides the braking roller 86 with the rotation load $F_B$ by the electromagnetic force. Additionally, the electronic brake 88 supplies the rotation load $F_B$ to the braking roller 86 in proportion to the applied voltage V. As the voltage V applied to the electronic clutch brake 88 increases, the rotation load $F_B$ supplied to the braking roller 86 increases. Decreasing the voltage V decreases the rotation load $F_B$ supplied to the braking roller 86. Thus, the rotation load $F_B$ supplied to the braking roller 86 may be controlled by adjusting the voltage V applied to the electronic clutch brake 88. As the electronic clutch brake 88 is in communication with the control unit 90, the voltage V applied to the electronic clutch brake 88 is controlled by the control unit 90. Since the structure and operation of the electronic clutch brake 88 is generally known, detailed description thereof is omitted herein. In this exemplary embodiment, the electronic clutch brake 88 supplies the rotation load $F_B$ to the second roller 66 via the braking roller 86. However, the electronic clutch brake 88 may directly drive the second roller 66 by mounting the electronic clutch brake 88 to the second rotation shaft CR2 of the second roller 66.

The first stopper 89*a* is mounted on the third rotation shaft CR3, and the second stopper 89*b* extends from the housing 62. The first and the second stoppers 89*a* and 89*b* restrict the movement of the second roller 66 on the outer circumference of the first roller 64 within a predetermined section indicated by the angle θ in FIG. 3B.

The input unit 92 may include a key assembly including a plurality of keys to set the type of printing medium. Being connected with the control unit 90 communicably by signals, the input unit 92 transmits information on the type of printing medium, which is inputted by a user, to the control unit 90. Although the user manually inputs the type of printing medium in this exemplary embodiment, the type of printing medium may be detected by a sensor formed on a document feeder or a feeding path of the printing medium so that information regarding the printing medium is transmitted to the control unit 90.

A memory 94 classifies the type of printing medium into a plurality of levels. The voltage V applied to the electronic clutch brake 88 is graded according to the type of printing medium and is stored in the form of a lookup table. Therefore, the type of printing medium as classified and the voltage V to be applied to the electronic clutch brake 88 according to the type of printing medium are stored in the memory 94. The memory 94 transmits the voltage V according to the type of printing medium as inputted to the control unit 90 and the voltage V is applied to the electronic clutch brake 88.

Hereinbelow, a method for controlling fusing pressure is described with reference to FIGS. 2 to 4 according to an exemplary embodiment of the present invention.

Figure 3B:
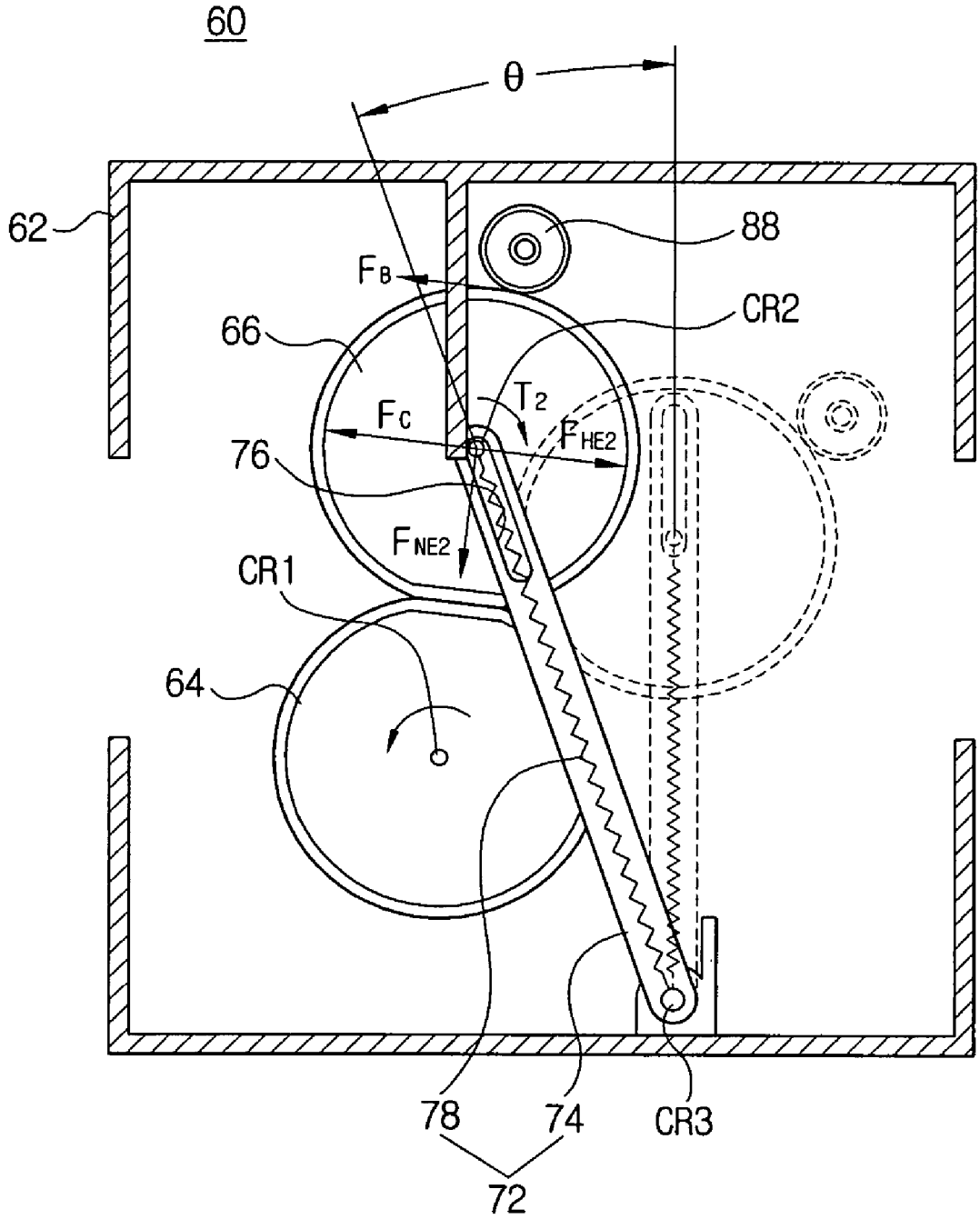
Figure 4:
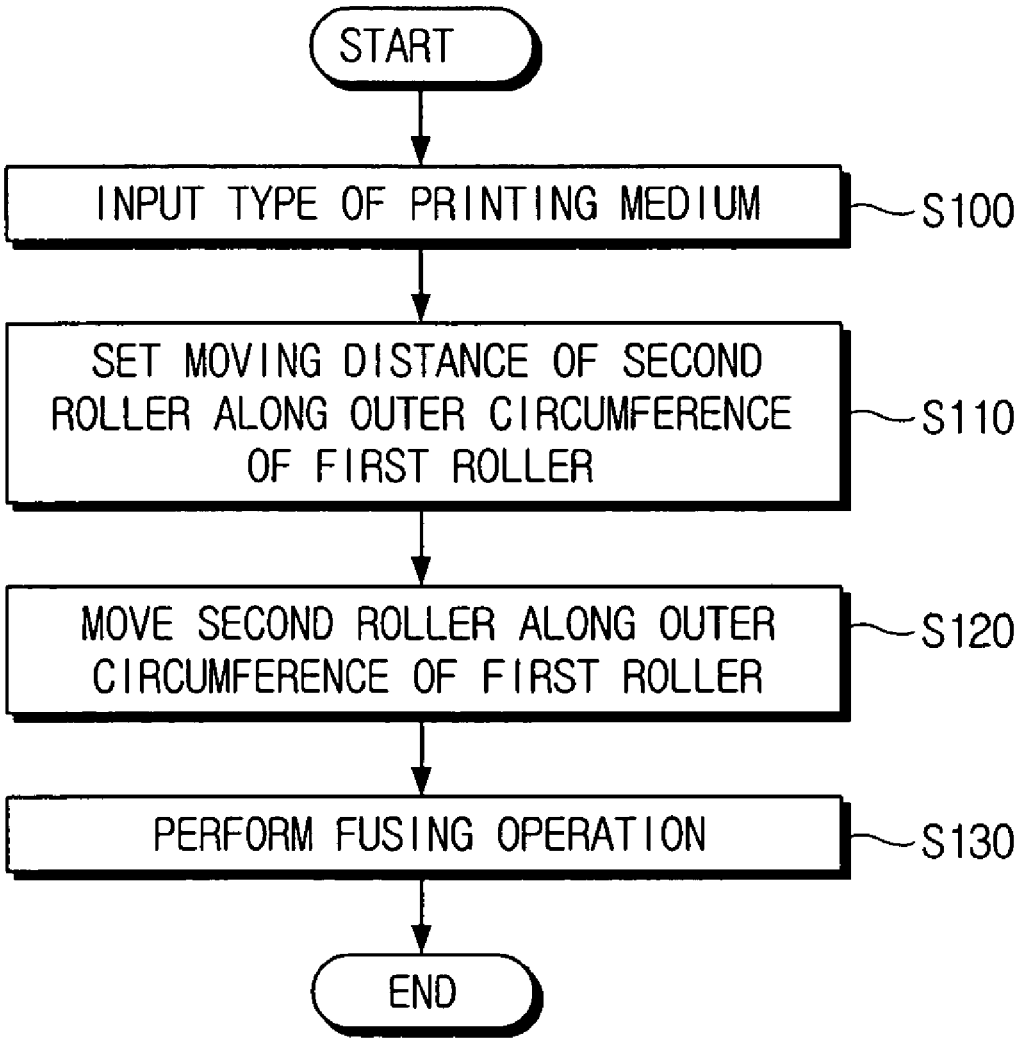
FIG. 4 is a flowchart of a method of controlling fusing pressure according to an exemplary embodiment of the present invention.

Referring to FIGS. 2 to 4, the user inputs the type of printing medium through the input unit 92. The type of the printing medium may be pre-classified so that the user may input the type of printing medium by selecting the pre-classified type of printing medium through the input unit 92 (S100). Alternatively, the information on the type of printing medium may be detected by the sensor provided on the document feeder or the feeding path of the printing medium and transmitted to the control unit 90. The method of controlling the fusing pressure is now described with reference to when an inputted printing medium requires an increase in the fusing pressure.

When the inputted printing medium requires an increase in the fusing pressure, in other words, when a thick printing medium is input, the control unit 90 turns on the driving motor 68 to rotate the first roller 64 about the rotation shaft CR1 in a direction A as shown in FIG. 3A. Therefore, the second roller 66 is rotated by the first roller 64 in a direction B by a rotation ratio of 1:1. At this time, when the rotation load $F_B$ is not being applied by the electronic clutch brake 88, the braking roller 86 idly rotates together with the second roller 66 in a direction C. The pivoting lever 74, being restricted by the first stopper 89*a*, cannot rotate clockwise with respect to FIG. 3A. Also, being restricted by the resilient member 78, the pivoting lever 74 cannot rotate counterclockwise.

The control unit 90 selects from the memory 94 the voltage V corresponding to the inputted type of printing medium. The rotation load $F_B$ supplied by the electronic clutch brake 88 to the braking roller 86 is proportional to the voltage V and also to the rotational load $F_B$ supplied by the braking roller 86 to the second roller 66. The rotational load $F_B$ is proportional to a distance of the section θ of the second roller 66 moving on the outer circumference of the first roller 64. Thus, as the control unit 90 selects the voltage V corresponding to the type of printing medium as inputted from the memory 94, the moving distance θ of the second roller 66 on the first roller 64 is determined (S110).

The control unit 90 applies the selected voltage V to the electronic clutch brake 88. Accordingly, the electronic clutch brake 88 supplies the rotational load $F_B$ to the braking roller 86. The braking roller 86 supplies the rotational load $F_B$ to the second roller 66. As shown in FIG. 3A, the second roller 66 moves in the tangential direction with the first roller 64. The second roller 66 moves along the outer circumference of the first roller 64 by the resilience $F_{NE1}$ of a radial component of the resilient member 78 in a position as shown in FIG. 3A. As the second roller 66 moves along the first roller 64, the resilient member 78 is extended, thereby increasing resiliences $F_{NE2}$ and $F_{HE2}$ in radial and tangential directions generated by the resilient member 78 in positions shown in FIGS. 3A and 3B, respectively. The resilience $F_{NE2}$ of the radial component is a component of the force of the second roller 66 for pressing the first roller 64. As the resilience $F_{NE2}$ of a radial component increases, the pressing force increases. The resilience $F_{HE2}$ of the tangential component restrains the movement of the second roller 66 on the outer circumference of the first roller 64. As shown in FIG. 3B, as the second roller 66 moves along the first roller 64, the resilience $F_{HE2}$ of the tangential component increases.

When the tangential resilience $F_{HE2}$ of the resilient member 78 increases to meet a point equal to the force $F_C$ tangentially operating on the second rotation shaft CR2, the second roller 66 stops its movement on the outer circumference of the first roller 64 (S120). At this point, the second roller 66 rotates in tight contact with the first roller 64 about the second rotation shaft CR2.

FIG. 3B shows a state that contacting pressure between the first and the second rollers 64 and 66 are the greatest. The second roller 66 may be disposed between a position thereof as shown in FIG. 3A and a position thereof as shown in FIG. 3B, according to the classified type of printing medium stored in the memory 94. Since the contacting pressure applied to the printing medium may be thus classified in detail, fusing efficiency may be improved. Furthermore, image quality may be accordingly improved.

FIG. 3B shows the position of the second roller 66 as moved the most along the outer circumference of the first roller 64. The second stopper 89*b* restricts the counterclockwise movement of the second roller 66.

When the second roller 66 is moved to a predetermined position on the outer circumference of the first roller 64, the position capable of obtaining the fusing pressure appropriate for the type of printing medium, the control unit 90 feeds the printing medium and performs the fusing operation (S130).

When the printing medium requires low fusing pressure, the contacting pressure between the first and the second rollers 64 and 66 needs to be decreased. Therefore, the control unit 90 applies a voltage lower than the voltage V supplied to the electronic clutch brake 88. As a result, rotational load $F_B$ supplied to the braking roller 86 is decreased and the rotational load $F_B$ applied to the second roller 66 is thereby decreased. Therefore, the force $F_C$ of the first roller 64 operating to the second rotation shaft CR2 in the tangential direction with the second roller 66 decreases to be lower than the resilience $F_{HE2}$ of the tangential component of the resilient member 78. Accordingly, the second roller 66 is moved clockwise along the outer circumference of the first roller 64 by the resilience $F_{HE2}$ of the tangential component. The resilient member 78 is contracted so that the resilience $F_{NE2}$ of the radial component of the resilient member 78 is decreased. The second roller 66 stops at the point where the decreasing resilience $F_{HE2}$ of the tangential component becomes equal to the force $F_C$ applied to the second rotation shaft CR2.

The voltage applied to the electronic clutch brake 88 may be controlled in greater detail. For example, an initial voltage V1 applied to the electronic clutch brake 88 at the beginning, a time T1 of applying the initial voltage V1, and a final voltage V2 applied at the time T1 after application of the initial voltage V1 are stored in the form of the lookup table to correspond to the classified type of printing medium. The control unit 90 selects the initial voltage V1, the time T1 of applying the initial voltage V, and the final voltage V2 in accordance with the inputted type of printing medium to thereby set the moving distance of the second roller 66 on the outer circumference of the first roller 64 (S110).

The control unit 90 applies the initial voltage V1 to the electronic clutch brake 88 and applies the final voltage V2 in the initial voltage application time T1. Therefore, the electronic clutch brake 88 supplies the rotational load $F_B$ corresponding to the initial voltage V1 to the second roller 66 via the braking roller 86 for the initial voltage application time T1. Accordingly, the second roller 66 is moved on the outer circumference of the first roller 64 by a predetermined distance according to the same principle as described above. Being moved by the predetermined distance, the final voltage V2 is applied to the electronic clutch brake 88 to stop the second roller 66 (S120). When the second roller 66 is stopped at the position on the outer circumference of the first roller 64, the position capable of obtaining the appropriate fusing pressure, the control unit 90 performs the fusing operation (S130). Thus, since the voltage applied to the electronic clutch brake 88 is divided into the initial voltage V1 and the final voltage V2, the position of the second roller 66 moving on the first roller 64 may be more accurately and promptly controlled.

As described above, according to an exemplary embodiment of the present invention, the fusing pressure may be adjusted in greater detail according to the type of printing medium without deteriorating printing speed. Consequently, the fusing performance and the image quality may be enhanced.

While the invention has been shown and described with reference to certain embodiments thereof, it will be understood by those skilled in the art that various changes in form and details may be made therein without departing from the spirit and scope of the invention as defined by the appended claims.

What is claimed is:

1. A fusing unit of an image forming apparatus, comprising:

a first roller rotating about a first rotation shaft (CR1);

a second roller rotating in contact with the first roller about a second rotation shaft (CR2) and movable along the outer circumference of the first roller;

a moving unit relocating the second roller according to a type of printing medium; and a pressing unit pressing the second roller toward the first roller by applying different pressures according to a position of the second roller with respect to the first roller.

2. The fusing unit of claim 1, wherein the pressing unit includes a pivoting lever having a first end pivotably mounted to a third rotation shaft (CR3) disposed at a different position from the first and the second rotation shafts (CR1) and (CR2) and a second end of the pivoting lever receives the second rotation shaft (CR2); and a resilient member having a first end mounted to the second rotation shaft (CR2) and a second end mounted on the pivoting lever between the second and the third rotation shafts (CR2) and (CR3).

3. The fusing unit of claim 1, wherein the pressing unit includes a pivoting lever having a first end pivotably mounted to a third rotation shaft (CR3) disposed at a different position from the first and the second rotation shafts (CR1) and (CR2) and a second end slidably receives the second rotation shaft (CR2) in a lengthwise direction of the pivoting lever; and a resilient member having a first end mounted to the second rotation shaft (CR2) and a second end mounted to the third rotation shaft (CR3).

4. The fusing unit of claim 3, wherein the pivoting lever has a groove proximal the first or the second end adapted to slide in the lengthwise direction of the pivoting lever.

5. The fusing unit of claim 1, wherein the moving unit includes a braking roller rotating in contact and together with the second roller; and an electronic clutch brake supplying a rotational load to the braking roller.

6. The fusing unit of claim 1, wherein first and second stoppers restrict movement of the second roller on the outer circumference of the first roller within a predetermined distance.

7. The fusing unit of claim 5, wherein a control unit controls the electronic clutch brake to vary the rotational load applied to the braking roller according to the type of printing medium inputted.

8. An image forming apparatus, comprising a fusing unit for fixing a visible image transferred onto a printing medium in accordance with printing information, wherein the fusing unit includes a first roller rotating about a first rotation shaft (CR1);

a second roller rotating in contact with the first roller about a second rotation shaft (CR2) and movable along the outer circumference of the first roller;

a moving unit relocating the second roller according to a type of printing medium; and a pressing unit pressing the second roller toward the first roller by applying different pressures according to a position of the second roller with respect to the first roller.

9. The image forming apparatus of claim 8, wherein the pressing unit includes a pivoting lever having a first end pivotably mounted to a third rotation shaft (CR3) disposed at a different position from the first and the second rotation shafts (CR1) and (CR2) and a second end of the pivoting lever slidably receives the second rotation shaft (CR2) in a lengthwise direction of the pivoting lever; and a resilient member having a first end mounted to the second rotation shaft (CR2) and a second end mounted on the pivoting lever between the second and the third rotation shafts (CR2) and (CR3).

10. The image forming apparatus of claim 9, wherein the moving unit includes a braking roller rotating in contact with the second roller together with the second roller;

an electronic clutch brake supplying a rotational load to the braking roller; and first and second stoppers restricting movement of the second roller on the outer circumference of the first roller within a predetermined distance.

11. The image forming apparatus of claim 8, wherein the pressing unit includes a pivoting lever having a first end pivotably mounted to a third rotation shaft (CR3) disposed at a different position from the first and the second rotation shafts (CR1) and (CR2) and a second end slidably receives the second rotation shaft (CR2) in a lengthwise direction of the pivoting lever; and a resilient member having a first end mounted to the second rotation shaft (CR2) and a second end mounted to the third rotation shaft (CR3).

12. The image forming apparatus of claim 11, wherein the moving unit includes a braking roller rotating in contact and together with the second roller; and an electronic clutch brake supplying a rotational load to the braking roller.

13. The image forming apparatus of claim 12, wherein the moving unit includes first and second stoppers restricting movement of the second roller on the outer circumference of the first roller within a predetermined distance.

14. The image forming apparatus of claim 13, wherein a control unit controls the electronic clutch brake to vary the rotational load applied to the braking roller according to the type of printing medium inputted.

15. A method for controlling fusing pressure in a fusing unit that includes first and second rollers rotating about first and second rotation shafts (CR1) and (CR2), respectively, in tight contact with each other, the method comprising the steps of a) setting a distance for the second roller to move along an outer circumference of the first roller according to a type of an inputted printing medium; and b) varying contacting pressure between the first and the second rollers by moving the second roller along the outer circumference of the first roller by the set distance.

16. The method of claim 15, wherein the step a) further comprises setting a voltage (V) to be applied to an electronic clutch brake that supplies a rotational load to the second roller rotating about the second rotation shaft (CR2).

17. The method of claim 15, wherein the step a) further comprises setting an initial voltage (V1) to be applied to an electronic clutch brake that supplies a rotational load to the braking roller rotating together with and in contact with the second roller, an initial voltage application time (T1), and a final voltage (V2).

18. The method of claim 17, wherein the step b) further comprises applying the initial voltage (V1) to the electronic clutch brake.

19. The method of claim 18, wherein the step b) further comprises applying the final voltage (V2) in the initial voltage application time after applying the initial voltage (V1) to the electronic clutch brake.

* * * * *